US006161343A

United States Patent [19]

Young

[11] Patent Number: 6,161,343

[45] **Date of Patent: *Dec. 19, 2000**

[54] WOOD ROT PREVENTING WOOD CASING END GRAIN MOISTURE BARRIER ASSEMBLY AND METHOD

[76] Inventor: Robert H. Young, 2902 Bethel Church Rd., Beaver Dam, Ky. 42320

[ * ] Notice: This patent issued on a continued prosecution application filed under 37 CFR 1.53(d), and is subject to the twenty year patent term provisions of 35 U.S.C. 154(a)(2).

[21] Appl. No.: 08/953,243

[22] Filed: Oct. 17, 1997

[51] Int. Cl.[7] ..... E06B 1/70

[52] U.S. Cl. ..... 52/97; 52/302.3; 52/169.5; 52/478; 49/467; 49/469; 49/471

[58] Field of Search ..... 52/97, 302.1, 302.3, 52/169.5, 478, 209; 49/467, 471, 469

[56] References Cited

U.S. PATENT DOCUMENTS

| | | | |
|---|---|---|---|
| 1,805,031 | 5/1931 | Baum . | |
| 1,813,223 | 7/1931 | Baum . | |
| 1,922,741 | 8/1933 | Miller . | |
| 2,754,551 | 7/1956 | Legnaioli . | |
| 2,999,280 | 9/1961 | Miller . | |
| 3,130,455 | 4/1964 | Borlenghi . | |
| 3,142,097 | 7/1964 | Oehmig . | |
| 3,204,380 | 9/1965 | Smith et al. | 52/309 |
| 3,349,519 | 10/1967 | Nehlig . | |
| 3,443,345 | 5/1969 | Spencer . | |
| 3,591,985 | 7/1971 | Coppins . | |
| 3,702,517 | 11/1972 | Martin . | |
| 3,762,100 | 10/1973 | Kempel . | |
| 3,851,420 | 12/1974 | Tibbetts | 49/471 |
| 3,854,246 | 12/1974 | McAllister . | |
| 3,871,133 | 3/1975 | Ellingson, Jr. . | |
| 4,114,319 | 9/1978 | Governale . | |
| 4,300,314 | 11/1981 | Dittrich . | |
| 4,330,972 | 5/1982 | Sailor . | |
| 4,483,267 | 11/1984 | Seemann, III . | |
| 4,513,536 | 4/1985 | Giguere . | |
| 4,686,121 | 8/1987 | Rogalla . | |
| 4,779,735 | 10/1988 | Kelso, Jr. . | |
| 4,945,680 | 8/1990 | Giguere | 49/468 |
| 5,138,806 | 8/1992 | Marx et al. . | |
| 5,179,804 | 1/1993 | Young | 49/471 |
| 5,433,806 | 7/1995 | Pasquali et al. . | |
| 5,475,948 | 12/1995 | Parke . | |
| 5,566,509 | 10/1996 | Long . | |
| 5,613,324 | 3/1997 | Theune . | |
| 5,634,303 | 6/1997 | Ellingson . | |
| 5,661,943 | 9/1997 | Hagel . | |
| 5,666,781 | 9/1997 | Egawa . | |
| 5,873,209 | 2/1999 | Hagel . | |
| 5,950,391 | 9/1999 | Hagel . | |

*Primary Examiner*—Carl D. Friedman
*Assistant Examiner*—M. Horton
*Attorney, Agent, or Firm*—Maurice L. Miller, Jr.

[57] ABSTRACT

A moisture barrier assembly for the end grain at the lower end of a wood casing such as door jambs, molding for exterior building sidings and window frames is disclosed. The barrier includes a moisture impervious plate such as plastic attached to and covering the entire lower surface of the casing. As an additional protective measure, a layer of a wood end grain sealant such as paraffin or other olefin wax is applied to the lower surface of the casing prior to attachment of the plate to the casing. The plate may also include one or more grooves or flutes across an upper surface portion thereof to permit air circulation between the plate and casing for drying the casing end grain in the event moisture seeps into the end grain through cracks or disruptions in the sealant layer from around the upper edges of the plate.

30 Claims, 3 Drawing Sheets

WOOD ROT PREVENTING WOOD CASING END GRAIN MOISTURE BARRIER ASSEMBLY AND METHOD

BACKGROUND OF THE INVENTION

This invention relates broadly to an assembly providing a moisture barrier on a lower surface of a wood casing, of the type used for window frames, door jambs, moldings for external building siding such as brick, stone, block, wood or vinyl, and other types of casings in order to prevent wood rot.

Such casings have bases which are often subjected to moisture or standing liquid such as rain water at various times throughout their use service lives. As a result, rotting of such casings at their bases is an ongoing problem. The problem is enhanced by the fact that the end grain of such a wood casing on its exposed lower surface has an affinity for absorbing moisture from the surface on which it is supported. The usual handling of these casings during transportation from mill to dealer, from dealer to job site and, thereafter, from handling at the job site can cause scratching, scoring, gouging or other disruptions of the end grain which will enhance moisture absorption into the end grain of wood.

Previous efforts to prevent wood rot of wood casings have not been a success. Attempts have included copper plating of fastener members, wrapping of preservative packages, surrounding the wood with moisture impervious materials, and the like. These prior attempts have not recognized that the source of wood rot is to a large extent based upon water absorption through the exposed end grain. Thus, because this point was not appreciated, prior efforts have been flawed from a design point, and have increased the problem. Exposed major surfaces do not usually contribute to wood rot, because there is little moisture to penetration. The moisture content must approach 25% for wood rot to be initiated, and that content cannot normally be approached unless an end grain surface is available. The end grain surface allows moisture to wick into the wood, with the result that the high moisture content may be achieved, particularly if left in standing water.

Placing the end grain surface on concrete, such as frequently occurs with slab construction, will not solve the problem. Concrete is a relatively porous material, so moisture may actually migrate through the concrete to the end grain surface. Thus a dam, plastic barrier, or the like applied to the major surfaces will not solve the problem, where the end grain surface rests upon concrete.

By means of my invention, this and other difficulties encountered using wood casings of the prior art are substantially reduced, if not altogether eliminated.

SUMMARY OF THE INVENTION

It is an object of my invention to provide a moisture barrier assembly for a lower surface of a wood casing in order to prevent wood rot.

It is a further object of my invention to provide a moisture barrier assembly for a lower surface of a wood door jamb.

It is another object of my invention to provide a moisture barrier for a lower surface of a wood molding for use with external siding such as brick, block, stone, wood or vinyl siding.

It is yet another object of my invention to provide a moisture barrier assembly for a lower surface of a window frame.

Briefly, in accordance with the objects of my invention, I provide, in combination with a wooden casing of the type used for exterior door jambs, window frames and molding for brick, block, stone, wood and vinyl siding and the like, an end grain moisture barrier assembly comprising a plate attached to and covering an exposed end grain surface of said casing.

These and other objects, features and advantages of the present invention will become apparent to those skilled in the art from the following detailed description and attached drawings on which, by way of example, only the preferred embodiments of my invention are illustrated.

DESCRIPTION OF THE PREFERRED EMBODIMENT

Figure 1:
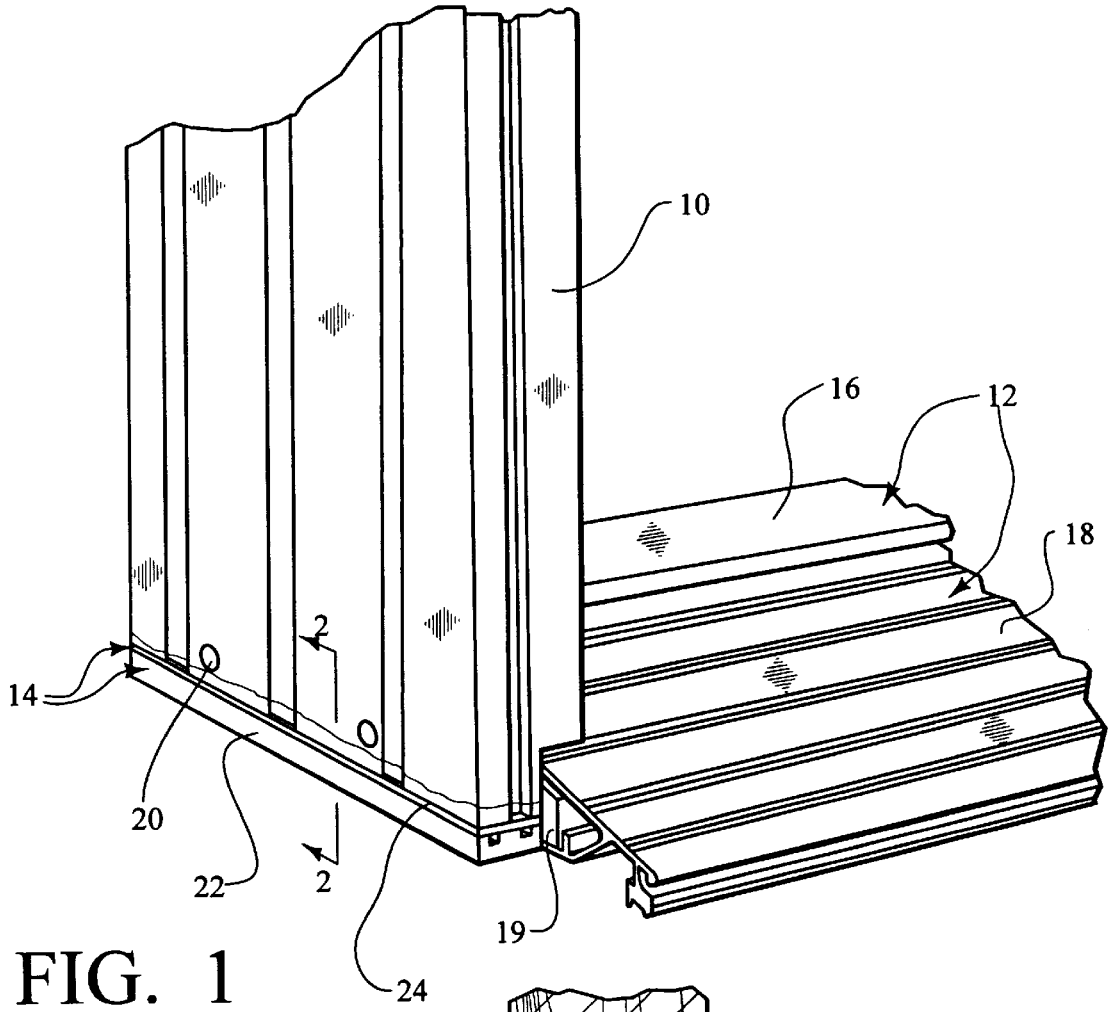
FIG. 1 shows a perspective view of a lower end portion of a wooden exterior door jamb and a side portion of an attached door sill, the door jamb employing an end grain moisture barrier assembly illustrating a preferred embodiment of my invention.
Figure 2:
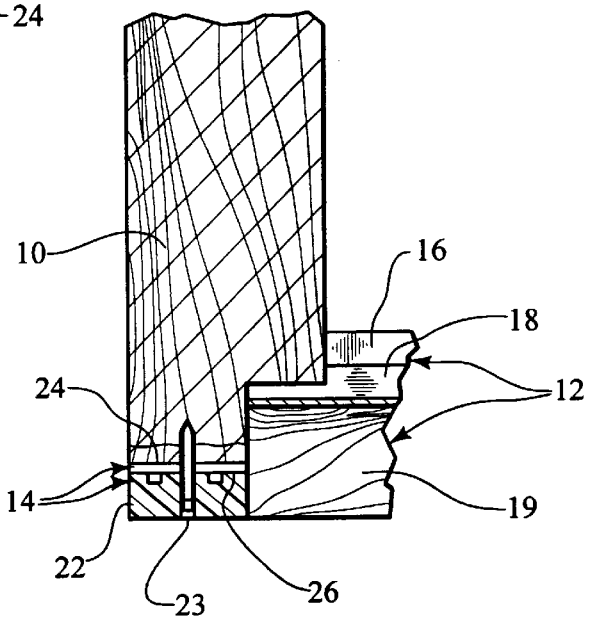
FIG. 2 shows a cross-sectional elevation view of the jamb, sill and assembly of FIG. 1 as viewed along cross-section lines 2—2 of the latter mentioned figure.

Referring now to FIGS. 1–2 there is shown, in a preferred embodiment of my invention, a wooden exterior door jamb 10, a conventional door sill assembly 12 which is attached to the side of the door jamb in the usual, well known manner, and a novel moisture barrier assembly 14 for the otherwise conventional door jamb. The sill assembly 12 includes the usual wooden threshold 16 and metal weather cover 18 covering an exterior side wooden base 19. A lower end portion of the door jamb 10 is attached to the base 19 of the sill assembly 12 by means of wood screws 20.

Now, in accordance with my invention, the moisture barrier assembly 14 includes a moisture impervious plate 22 which is attached to and covers the entire surface area at the lower end grain exposed surface of the jamb 10. By end grain exposed surface, I mean a surface cut transverse to the longitudinal orientation of the grain. In other words, a surface exposing the growth rings of the wood. The plate 22 should be of water resistant construction and should preferably have a shape which conforms to the base of the jamb 10, so as not to project beyond the edges thereof. I prefer to construct the plate 22 of a suitable plastic such as, for example, a high density polyethylene or polyvinyl chloride. While the plate 22 can be attached to the bottom of the jamb 10 in any suitable manner, I prefer to use conventional gun driven steel pins 23 having 1/16 inch diameters which are aligned in a single row and which are spaced about one inch apart. It is only important that the pins 23 or other fastening means used do not split the wood at the base of the jamb 10, and are sufficient to hold the plate 22 securely in place until the jamb, with plate attached, is permanently set in operative position during doorway construction. While the thickness of the plate 22 is not especially critical, I have found that a plate thickness of 3/16 inch is satisfactory. For a plate of this thickness, I prefer to secure it to the jamb using the previously mentioned pins 23 which have ¾ inch lengths.

While the plate 22 can be directly applied to the lower end of the jamb 10 as previously explained in order to provide an improved moisture barrier for the lower end of the jamb, I envision the possibility that, over an extended period of time moisture might still seep into the lower end grain of the jamb 10 around the upper edges of the plate 22. To provide additional protection and to guard against such a possibility, I prefer to take the further step of applying a coating or layer 24 of a suitable wood end grain sealant to the entire lower end of the jamb 10 prior to attaching the plate 22 to the jamb. While a conventional water seal of the type used on outside wood decks and the like might be suitable, I prefer to use an olefin wax such as paraffin. Another sealant which shows promise is a mixture of paraffin wax and petroleum jelly suitable to form a thick grease.

In using paraffin wax as the sealant, I use a double boiler arrangement containing water in a first trough which can be heated to an elevated temperature. A second trough is suspended in the first trough such that the water in the first trough is against the base of the second trough. Paraffin is then placed in the second trough and the water in the first trough is heated until the wax in the second trough is melted and reaches a temperature of about 175° F., at which point the lower end of the jamb 10 or other type of wooden casing, as the case may be, is touched to the surface of the melted wax pool in the second trough. The lower end of the jamb 10 or casing is held in contact with the surface of the melted wax pool whereupon moisture residing in the end grain of the wood escapes and bubbles out of the wax pool around the edges of the wood. This bubbling process will normally run its full course in about one minute from the time the end grain of the casing first touches the surface of the pool. After the bubbling stops, the casing is withdrawn from the second trough, whereupon the wax rapidly cools and solidifies on the lower end of the casing. The plate 22 may then be applied to the jamb 10 over the wax layer 24 as previously explained.

In the event the sealant of the layer 24 contains voids, cracks or other disruptions through which moisture might enter the lower end grain of the jamb 10 from around the upper edges of the plate 22, I further provide means for circulating ambient air through the plate 22 so as to contact the exposed lower surface of the casing to aid in carrying off moisture to dry the same. To this end, I grind at least one flute or groove 26 across an upper surface portion of the plate 22. In the present example, I provide a pair of spaced apart, parallel extending grooves 26 which run from an outside edge to an inside edge of the plate 22. For a 3/16 inch thick plate, I prefer to grind the grooves 26 to a depth of 1/16 inch.

Figure 3:
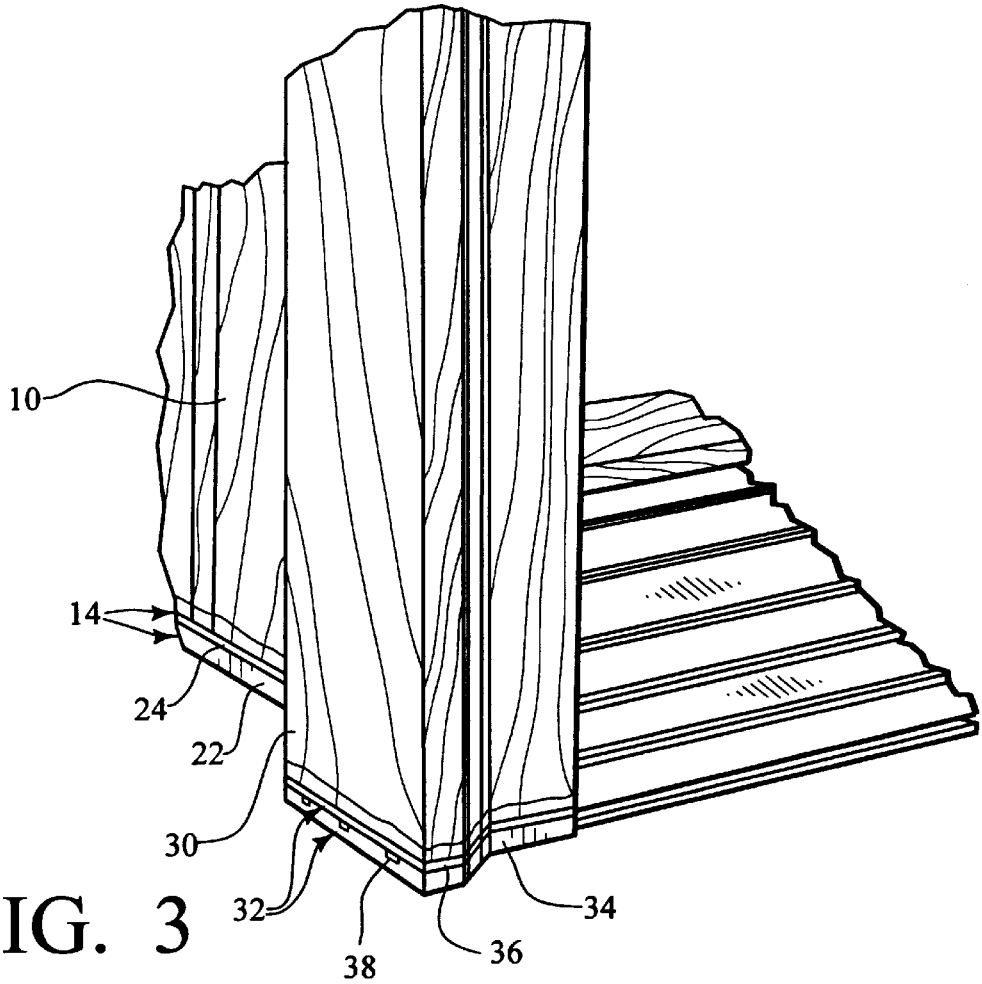
FIG. 3 shows a perspective view of a lower end portion of the jamb, sill and assembly of FIGS. 1–2 with a wooden brick molding added, the brick molding also employing an end grain moisture barrier assembly, thus illustrating another important embodiment of my invention.

Referring now to FIG. 3 there is shown a casing comprising an exterior wood molding 30 for siding such as brick, block, stone, wood, vinyl or the like. In this example, the molding 30 is applied to an exterior face of the door jamb 10 along an exterior side of the door sill 12, the jamb 10 and sill 12 being the same as shown in FIGS. 1–2. A lower surface of the molding 30 contains a moisture barrier assembly 32 which includes a covering plate 34 and a wood end grain sealant layer 36 formed and applied as in the previous example with reference to FIGS. 1–2. The plate 34 of the present example includes a series of spaced apart, parallel extending, upwardly opening, air circulation grooves 38 formed in an upper surface portion thereof for circulating air to dry the end grain of the molding 30 in the event moisture seeps therein from around the upper edges of the plate and through any disruptions in the layer 36 that may exist.

Figure 4:
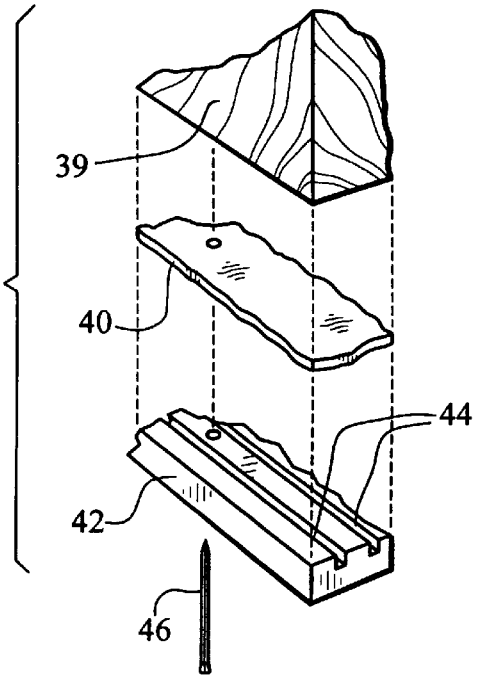
FIG. 4 shows an exploded perspective view of a lower end portion of a generalized wooden outer casing for a door jamb, molding for exterior siding, or a window frame employing the moisture barrier assembly of my invention.

Referring now to FIG. 4 there is shown in still another important embodiment of my invention, a lower end portion of a generalized wood casing 39 which may be of any well known type such as a door jamb, a molding for siding, a window frame on a casing for any other purpose. As in the previous examples, a moisture barrier is applied to completely cover a lower surface of the casing 39 which includes a layer 40 of wood end grain sealant, such as paraffin, and a moisture resistant plate 42 containing a pair of spaced apart, parallel extending, upwardly opening, air circulation grooves 44. If the layer 40 is paraffin, it may be applied to the lower end of the casing 39 as previously explained, after which the plate 42 may be secured to cover the layer 40 and the lower end grain of the casing 39 with pins 46 or other suitable fasteners, also as previously explained.

Figure 5:
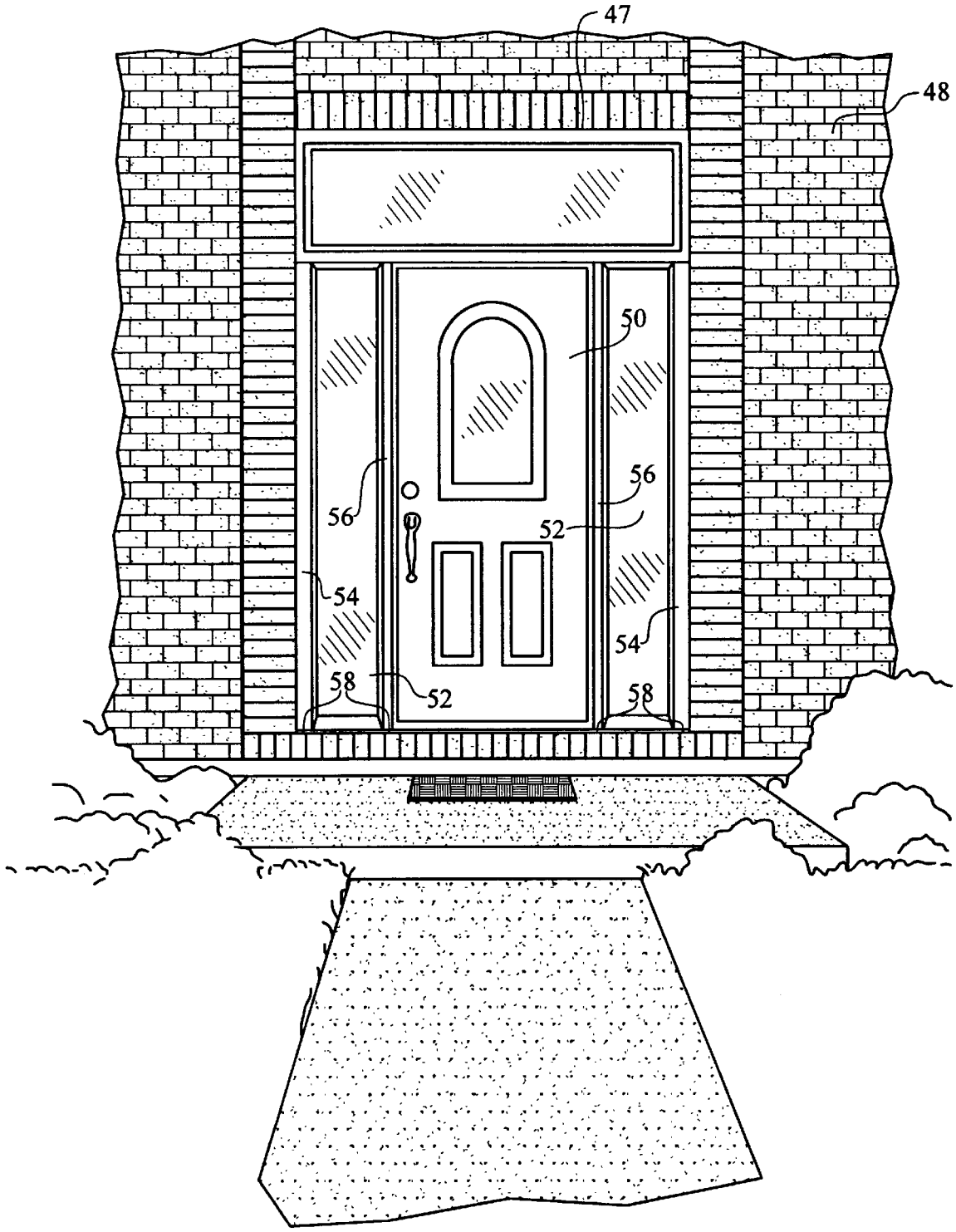
FIG. 5 shows a front elevation view and an oblique projection of an outside entrance door to a residence or other building illustrating various uses for the moisture barrier assembly of the present invention.

Referring now to FIG. 5, an example of various uses for the moisture barrier of my invention is shown in a fancy exterior door assembly 47 for a brick sided residence 48. Included in the assembly 47 is a door 50 and a pair of side windows 52. A pair of wood casings 54 are provided, each of which doubles as a molding for the brick siding 48 and as a side frame for the windows 52. A pair of moldings 56 cover a frame for the door 50, a door jamb of the frame being located directly behind the molding 56 located on the left side of the door 50 as viewed. At the base 58 of each of the casings, including the jamb behind the left side door and window frame molding 56, a moisture barrier assembly as shown and explained in the previous examples may be employed to protect the bases of these casings from rotting.

Although the present invention has been described with respect to specific details of certain preferred embodiments thereof, it is not intended that such details limit the scope of this patent other than as specifically set forth in the following claims.

I claim:

1. In combination with a wooden casing of the type used for exterior door jambs, window frames and molding for brick, block, stone, wood and vinyl siding, an end grain moisture barrier assembly comprising a moisture impervious plate attached to and covering a lower end grain surface of said casing said plate having length dimension and a thickness dimension and the length dimension exceeding the thickness dimension and the plate being attached to said lower end grain surface along said length dimension.

2. The assembly of claim 1 further comprising a moisture barrier layer of wood end grain sealant applied to an end surface of said casing prior to attachment of said plate to said casing.

3. The assembly of claim 1 wherein said plate defines at least one groove in an upper surface portion thereof which extends across an upper surface of said plate and which opens toward a lower surface of said casing for providing an air circulation path to dry said lower surface of said casing in the event moisture finds its way into said end surface between said casing and said plate.

4. The assembly of claim 1 wherein said casing comprises a door jamb.

5. The assembly of claim 1 wherein said casing comprises a molding for siding.

6. The assembly of claim 1 wherein said casing comprises a window frame.

7. The assembly of claim 1 wherein said plate is constructed of plastic.

8. The assembly of claim 1 wherein said plate is attached to said casing by metal pins.

9. The assembly of claim 1 wherein the area of said plate conforms to the shape of the lower end of said casing.

10. The assembly of claim 2 wherein said sealant comprises paraffin wax.

11. The assembly of claim 3 wherein said plate defines two spaced apart, parallel extending ones of said groove.

12. The assembly of claim 3 further comprising a layer of wood grain sealant applied to the end surface of said casing prior to attachment of said plate to said casing, said at least one groove also opening against said layer for providing an air circulation path to dry the lower end grain of said casing in the event said layer is disrupted and in the event moisture finds its way into said end grain between said casing and said plate through said disrupted layer.

13. In combination with a wooden door jamb, an end grain moisture barrier assembly comprising a relatively flat plate attached to and covering an end surface of said jamb, said plate defining at least one groove in an upper surface portion thereof which extends across said plate for providing an air circulation path to dry the end grain of said end surface of said jamb in the event moisture finds its way into said end grain between said jamb and said plate.

14. The assembly of claim 13 further comprising a moisture resistant layer of wood end grain sealant applied to the end surface of said jamb prior to attachment of said plate to said casing.

15. The assembly of claim 13 wherein said plate is constructed of plastic.

16. In combination with a wooden molding for siding, an end grain moisture barrier assembly comprising a relatively flat plate attached to and covering an end surface of said molding, said plate defining at least one groove in a surface portion thereof which extends across said plate for providing an air circulation path to dry the end grain of said end surface of said molding in the event moisture finds its way into said end grain between said molding and said plate.

17. The assembly of claim 16 further comprising a moisture resistant layer of wood end grain sealant applied to an end surface of said molding prior to attachment of said plate to said molding.

18. The assembly of claim 16 wherein said plate is constructed of plastic.

19. In combination with a wooden window frame, an end grain moisture barrier assembly comprising a relatively flat plate attached to and covering an end surface of said frame.

20. The assembly of claim 19 further comprising a moisture resistant layer of wood end grain sealant applied to an end surface of said frame prior to attachment of said plate to said molding.

21. The assembly of claim 19 wherein said plate is constructed of plastic.

22. A method for applying a moisture barrier to an end surface of a wood casing, the steps of which comprise:

providing a wood casing having an exposed end grain on an end surface thereof, forming a plate of moisture resistant material to cover said end surface, the plate having a length dimension and a thickness dimension and the length dimension exceeding the thickness dimension, and attaching said plate along the length dimension to said end surface.

23. The method of claim 22, the steps of which further comprise coating and end surface with a layer of melted wax prior to the step of attaching said plate, and, thereafter, allowing said melted wax to cool and solidify prior to the step of attaching said plate.

24. The method of claim 22, the steps of which further comprise forming at least one groove across surface of said plate prior to the step of attaching said plate such that said groove opens toward said end surface.

25. The method of claim 23, wherein said melted wax comprises paraffin.

26. The method of claim 25, the steps of which further comprise having a quantity of paraffin wax to obtain a quantity of said method wax and raise its temperature to about 175° F. prior to the step of coating said end surface.

27. The method of claim 26, including the step of contacting the melted wax with an end of the casing, and maintaining contact until moisture bubbling from the end ceases.

28. A method of preventing wood rot, comprising the steps of:

a) providing a wooden element having a wood grain exposed end surface;

b) contacting the wood grain exposed end surface with a liquefied moisture impervious material, and moisture impervious coating to be formed on the wood grain exposed end surface; and c) applying a moisture impervious plate to the coating, and securing the plate to the wooden element.

29. The method of claim 28, including the step of:

a) providing molten wax as the moisture impervious coating.

30. The method of claim 28, including the step of:

a) providing a plate forward from the group consisting of high density polyethylene and polyvinyl chloride.

* * * * *